US010017228B2

(12) United States Patent
Porel

(10) Patent No.: US 10,017,228 B2
(45) Date of Patent: Jul. 10, 2018

(54) HYDRAULIC DEVICE FOR CONTROLLING THE DEPTH OF AN IMMERSIBLE OBJECT

(71) Applicant: HYDRO LEDUC, Azerailles (FR)

(72) Inventor: Louis-Claude Porel, Jeanmenil (FR)

(73) Assignee: HYDRO LEDUC, Azerailles (FR)

( * ) Notice: Subject to any disclaimer, the term of this patent is extended or adjusted under 35 U.S.C. 154(b) by 0 days.

(21) Appl. No.: 15/513,579

(22) PCT Filed: Sep. 25, 2015

(86) PCT No.: PCT/FR2015/052564

§ 371 (c)(1),
(2) Date: Mar. 23, 2017

(87) PCT Pub. No.: WO2016/046505

PCT Pub. Date: Mar. 31, 2016

(65) Prior Publication Data

US 2017/0297659 A1 Oct. 19, 2017

(30) Foreign Application Priority Data

Sep. 25, 2014 (FR) ..... 14 59097

(51) Int. Cl.
*B63B 22/20* (2006.01)

(52) U.S. Cl.
CPC ..... *B63B 22/20* (2013.01); *B63B 2207/02* (2013.01); *B63B 2211/02* (2013.01)

(58) Field of Classification Search
CPC ..... B63B 22/20
See application file for complete search history.

(56) References Cited

U.S. PATENT DOCUMENTS 4,246,923 A * 1/1981 Dayet ..... F15B 1/02 137/116.3
4,872,472 A * 10/1989 Lefevre ..... F16K 11/0704 137/116.3

(Continued)

FOREIGN PATENT DOCUMENTS

| | | |
|---|---|---|
| FR | 2834557 A1 | 7/2003 |
| JP | S517517 A | 1/1976 |
| JP | S62187692 A | 8/1987 |

OTHER PUBLICATIONS

International Search Report with regard to PCT/FR2015/052564 dated Jan. 22, 2016.

(Continued)

*Primary Examiner* — Stephen P Avila

(57) ABSTRACT

A hydraulic depth-control device for a submersible body comprises:
a variable-volume ballast space,
a pressure accumulator comprising a hydraulic chamber and a gas chamber, which chambers are separated by a deformable or mobile wall, the gas chamber containing a gas at an absolute pressure higher than atmospheric pressure,
a hydraulic pump coupled to an electric motor, the hydraulic pump having a suction inlet connected to the ballast space and a delivery outlet connected to the hydraulic chamber of the pressure accumulator,
a return hydraulic circuit connecting the hydraulic chamber of the pressure accumulator to the ballast space via an electrically operated valve, and
a hydraulic fluid arranged in the ballast space, the hydraulic pump, the hydraulic chamber of the pressure accumulator and the return hydraulic circuit.

13 Claims, 2 Drawing Sheets

(56) References Cited

U.S. PATENT DOCUMENTS

| | | | | |
|---|---|---|---|---|
| 9,582,987 | B2 * | 2/2017 | Eskildsen | G01F 23/64 |
| 9,593,947 | B2 * | 3/2017 | Tian | G01N 33/1886 |
| 2008/0087209 | A1 | 4/2008 | Yoshida et al. | |
| 2012/0204775 | A1 | 8/2012 | Watanabe et al. | |

OTHER PUBLICATIONS

English Abstract of JP S62 187692 retrieved on Espacenet on Mar. 20, 2017.
English Abstract of FR 2834557 retrieved on Espacenet on Mar. 20, 2017.

* cited by examiner

HYDRAULIC DEVICE FOR CONTROLLING THE DEPTH OF AN IMMERSIBLE OBJECT

CROSS-REFERENCE

The present application is a National Stage Entry of International Patent Application No. PCT/FR2015/052564 filed on Sep. 25, 2015 and claims priority of the French Patent Application No. 1459097 filed on Sep. 25, 2014 the entire contents of which are incorporated herein by reference.

The invention relates to the field of hydraulic depth-control device for submersible bodies, notably for underwater probes.

Various underwater vehicles and tools may require a buoyancy-control or depth-control device. Autonomous underwater probes used for oceanographic research are, for example, described in the articles:

"The Autonomous Lagrangian Circulation Explorer (ALACE)" R. E. Davis et al., J. of Atmospheric Research and Oceanic Technology, vol. 9 pp 264-285 (1992), and "Seaglider: a long-range Autonomous Underwater Vehicle for oceanographic research" C. C. Ericksen et al., IEEE J. of Oceanographic engineering, vol. 26, No 4 pp 424-436 (2001).

For example, such underwater probes carry sensors used to measure the salinity of the oceans, to measure the propagation of sound, to measure the temperature of the water, or the like. The objectives of these measurements may notably be concerned with predicting climate change, establishing maps of underwater circulation or identifying large migrations of aquatic fauna.

The underwater probe is used during ocean measurement campaigns. It is dropped into the ocean from a boat or released from an aircraft capable of flying low over the water. From the time that it enters the water, the probe dives to the measurement depth which corresponds to the program of the measurement campaign and will drift, for example at a substantially constant depth, in order to take the programmed measurements. Typically, the underwater probe needs to reascend to the surface of the ocean in order to communicate, via satellite, the measurements that are taken.

In probes of this type, the autonomy in terms of energy and the duration of autonomous operation are key to the effectiveness of the measurement campaigns. For example, an autonomy of two years or more may be desired, depending on the application.

In the aforementioned ALACE system, a hydraulic pump is used during the reascent phase in order to transfer a fluid from an internal reservoir kept at a depression under 0.7 atm to a ballast space which experiences the hydrostatic pressure at the depth to which the probe has dived. This results in a great deal of power being consumed at great depth. In addition, the very great pressure differences applied at great depth to this pump and to the hydraulic valves of the system make obtaining acceptable sealing an extremely complicated matter.

Document JPS517517 describes a device for transferring fluid between a fixed reservoir and a variable-volume flexible reservoir in which a pump is used to transfer fluid between the reservoir whatever the direction in which the fluid is being transferred. The transfer of fluid is also controlled using a pressure regulating valve comprising a first compartment and a second compartment which are separated by a piston. The first compartment of the pressure regulating valve is supplied with fluid by the pump and has an outlet orifice of the pressure regulating valve. The second compartment of the pressure regulating valve is supplied with fluid by a selective valve and comprises a spring applying thrust to the piston in order to push it toward the first compartment. The selective valve supplies the pressure regulating valve with fluid using fluid from the reservoir that is at the highest internal pressure. Whichever reservoir it is that has the highest internal pressure and whichever the direction of fluid transfer between the fixed reservoir and the flexible reservoir, the pump is always activated in order to achieve said transfer of fluid.

One idea underlying the invention is that of providing a hydraulic depth-control device that is economical with energy. Certain aspects of the invention are derived from the idea of providing a hydraulic depth-control device that offers high reliability.

According to one embodiment, the invention provides a hydraulic depth-control device for a submersible body, the device comprising:

a variable-volume ballast space, at least one pressure accumulator comprising a hydraulic chamber delimited by a deformable or mobile wall and a loading means applying a load higher than atmospheric pressure to the deformable or mobile wall, a hydraulic pump coupled to an electric motor, the hydraulic pump having a suction inlet connected to the ballast space and a delivery outlet connected to the hydraulic chamber of the pressure accumulator, a return hydraulic circuit connecting the hydraulic chamber of the pressure accumulator to the ballast space via an electrically operated valve, a hydraulic fluid arranged in the ballast space, the hydraulic pump, the hydraulic chamber of the pressure accumulator and the return hydraulic circuit, and an electric control module able to power the electric motor of the pump and the electrically operated valve in a controlled manner, the electric control module being configured to, in a diving phase, activate the hydraulic pump and keep the electrically operated valve in a closed configuration so as to transfer hydraulic fluid from the ballast space into the hydraulic chamber of the pressure accumulator and, in a reascent phase, deactivate the hydraulic pump and keep the electrically-operated valve in an open configuration so as to transfer hydraulic fluid from the hydraulic chamber of the pressure accumulator to the ballast space.

These features yield numerous advantages:

- it is possible to operate the pump with a relatively low pressure differential between the suction side and the delivery side during the dive phase, so that the electrical power consumption is reduced.
- throughout the phases of operation, the pump and the hydraulic distributor have to withstand only the pressure differential between the ballast space and the pressure accumulator, irrespective of the absolute pressure prevailing at the depth of dive reached by the device, which means that the reliability and sealing of the pump and of the hydraulic distributor can be assured, in a relatively simple and inexpensive manner.

There is no longer any need to provide an internal reservoir kept at a depression, and this makes manufacture easier. According to embodiments, such a device may further comprise one or more of the following features.

The electrically-operated valve may be produced in various ways. According to one embodiment, the electrically-operated valve adopts the open configuration when not powered and is able to be switched into the closed configuration in response to an electrical power signal. Such an arrangement improves the reliability of the device because an electrical power failure then triggers the reascent phase, making it easier to locate and recover the device. According to another embodiment, the electrically-operated valve adopts the closed configuration when not powered and is able to be switched into the open configuration in response to an electrical power signal. Such an arrangement may also be chosen for the sake of energy saving, for example if the reascent phase is relatively short in comparison with the dive phase.

The pressure accumulator may be embodied in various ways. According to one embodiment, the or each pressure accumulator is a hydropneumatic accumulator in which the loading means comprises a gas chamber separated from the hydraulic chamber by the deformable or mobile wall, the gas chamber containing a gas at an absolute pressure higher than atmospheric pressure. Alternatively, the loading means may be embodied by a compression spring.

According to one embodiment which is not depicted, the pressure accumulator comprises a rigid cylindrical space containing the hydraulic chamber and the gas chamber and the deformable wall produced in the form of a flexible membrane arranged in the rigid cylindrical space and separating the hydraulic chamber from the gas chamber.

According to another embodiment, the pressure accumulator comprises a rigid cylindrical space containing the hydraulic chamber and the gas chamber and the mobile wall produced in the form of a piston sliding in a sealed manner in the rigid cylindrical space and separating the hydraulic chamber from the gas chamber.

According to one preferred embodiment, the device comprises a low-pressure accumulator comprising a first hydraulic chamber delimited by a first deformable or mobile wall and a first loading means, applying a load to the first deformable or mobile wall and a high-pressure accumulator comprising a second hydraulic chamber delimited by a second deformable or mobile wall and a second loading means applying a load to the second deformable or mobile wall, the delivery outlet of the pump being connected in parallel to the first hydraulic chamber and to the second hydraulic chamber, the first hydraulic chamber and the second hydraulic chamber being connected in parallel to the return hydraulic circuit, the load of the first loading means on the first deformable or mobile wall being comprised between atmospheric pressure and the load of the second loading means on the second deformable or mobile wall.

By virtue of these arrangements, two parallel pressure accumulators operating at increasing operating pressures may be provided on the delivery side of the pump, thereby offering numerous advantages:

- that makes it possible to limit the pressure differential between the suction side and the delivery side of the pump during the dive phase, notably by providing a low-pressure and high-capacity accumulator for an initial loss-of-buoyancy phase.
- that makes it possible to offer a high-amplitude operating pressure and therefore to obtain a great depth of dive despite the limited volumetric ratios of the pressure accumulators.

More than two accumulators may also be provided in the same way.

According to one embodiment, the low-pressure accumulator comprises a blocking means, blocking the movement or deformation of the deformable or mobile wall when the hydraulic chamber reaches a predefined volume, so that the gas pressure in the gas chamber does not exceed a predefined maximum pressure. By virtue of these arrangements, the low-pressure accumulator comes into a position of abutment or blockage beyond a certain depth, so that it becomes functionally inactive at a greater depth and does not need to withstand higher internal pressures. By virtue of these arrangements, the low-pressure accumulator operates under a limited pressure and is used chiefly during the less deep phases of operation, whereas the high-pressure accumulator is used to build up and release a higher pressure for the deepest phases of the operation.

It is thus possible to optimize the difference in pressure between the ballast space and the pressure accumulators in all phases of operation of the device. According to one embodiment, the low-pressure accumulator is designed to produce the loss of buoyancy of the submersible body and a first phase of diving down to a relatively shallow depth, something which may require a relatively high volume of fluid if the submersible body was initially released far above the buoyancy limit. However, this volume is transferred at a relatively low pressure.

According to a corresponding embodiment, the capacity of the low-pressure accumulator is greater than the capacity of the high-pressure accumulator.

The two pressure accumulators may be embodied in different ways, similarly to or differently from one another. According to one embodiment, the two pressure accumulators are hydropneumatic accumulators, the absolute gas pressure in the first gas chamber being comprised between atmospheric pressure and the gas pressure in the second gas chamber.

According to one embodiment, the gas pressure prevailing in the second gas chamber for a state of minimum filling of the second hydraulic chamber is greater than the predefined maximum pressure of the first gas chamber. By virtue of these arrangements, the high-pressure accumulator does not come into operation until after the low-pressure accumulator is completely filled, which corresponds to the submersible body being immersed down to a relatively shallow certain depth. Given this delayed entry into operation, the high-pressure accumulator provides a device capable of diving to great depth, within the limits of the volumetric ratio of the high-pressure accumulator. This then achieves complete disassociation of the two functions: the function of acquiring and losing buoyancy, which is provided by the low-pressure accumulator, and the function of diving to and reascending from great depth, which is provided by the high-pressure accumulator.

According to one embodiment, the low-pressure accumulator comprises a first rigid cylindrical space containing the first hydraulic chamber and the first gas chamber and the mobile wall produced in the form of a first piston sliding in a sealed manner in the first rigid cylindrical space and separating the first hydraulic chamber from the first gas chamber, the high-pressure accumulator comprises a second rigid cylindrical space containing the second hydraulic chamber and the second gas chamber and the mobile wall produced in the form of a second piston sliding in a sealed manner in the second rigid cylindrical space and separating the second hydraulic chamber from the second gas chamber, and the first and second rigid cylindrical spaces are arranged coaxially on each side of a separation wall, the first gas chamber being defined between the first piston and a first end wall closing one side of the first rigid space opposite to the separating wall, the first hydraulic chamber being defined between the first piston and the separating wall, the second gas chamber being defined between the second piston and a second end wall closing one side of the second rigid space opposite to the separating wall, the second hydraulic chamber being defined between the second piston and the separating wall, a fluid canal arranged in the separating wall, the fluid canal having an opening onto an exterior surface of the separating wall, a first branch connecting the opening to the first hydraulic chamber and a second branch connecting the opening to the second hydraulic chamber, the opening of the fluid canal being connected to the return hydraulic circuit and to the hydraulic pump. For preference, in this case, the low-pressure accumulator comprises a mechanical stop which limits its volumetric ratio.

According to one embodiment, the first piston is in abutment against the separating wall in a state of minimum filling of the first hydraulic chamber and the second piston is in abutment against the separating wall in a state of minimum filling of the second hydraulic chamber.

The hydraulic pump may be embodied in different ways. According to one embodiment, the hydraulic pump is a swashplate micropump. A gear pump may also be envisioned.

According to one embodiment, the invention also provides an underwater probe comprising a submersible body, the submersible body containing a sensor able to measure a physical property of the environment of the probe, a wireless communication device able to transmit measurements acquired by the sensor and an aforementioned device for controlling the depth of the submersible body.

The invention will be better understood and further objects, details, features and advantages thereof will become more clearly apparent during the course of the following description of a number of particular embodiments of the invention which are given solely by way of nonlimiting illustration with reference to the attached drawings.

Figure 1:
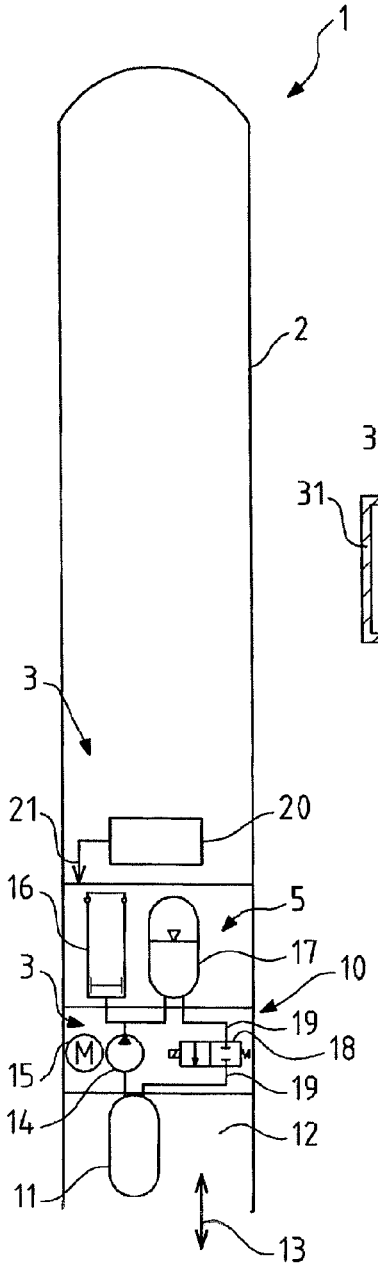
FIG. 1 is a functional schematic depiction of an underwater probe in which a depth-control device is used.

With reference to FIG. 1, an underwater probe 1 comprises a pressure-resistant elongate body 2 for moving around underwater. In particular, the elongate body 2 comprises watertight volumes 3 in which various items of equipment necessary for the operations of the probe are mounted. The design of such a probe is known from elsewhere and will not be fully described in detail. The description herein below refers to the device 10 for controlling the depth of the probe 1.

The depth-control device 10 comprises a ballast space 11 which is housed in a chamber 12 of the body 2, which is open at its lower side as indicated by the arrow 13. Thus, the ballast space 11 is in contact with the seawater and makes it possible to modify the upthrust experienced by the probe 1 when the volume of the ballast space 11 is varied. To do that, the ballast space 11 is created for example in the form of a flexible elastomer envelope.

The variations in volume of the ballast space 11 are controlled by means of a hydraulic device housed in the body 2 and operating with a noncompressible fluid such as an oil, and comprising:

A pressure-accumulator assembly 5,

A hydraulic pump 14 coupled to an electric motor 15 forming an electric pump unit, the suction inlet of which is connected to the ballast space 11 and the delivery outlet of which is connected to the pressure accumulator assembly 5, and A return circuit 19 also connecting the pressure accumulator assembly 5 to the ballast space 11 and in which a hydraulic distributor 18 is interposed.

In the embodiment depicted in FIG. 1, the pressure accumulator assembly 5 comprises two hydropneumatic accumulators connected in parallel, namely also a low-pressure accumulator 16 and a high-pressure accumulator 17. In a state of rest corresponding to the state of maximum filling of the ballast space 11, namely also to the position of minimum depth of the probe, the gas pressure in the low-pressure accumulator 16 is smaller than the gas pressure in the high-pressure accumulator 17. That makes it possible to provide two successive pressure levels on the delivery side of the pump, as will be explained later on.

Figure 2:
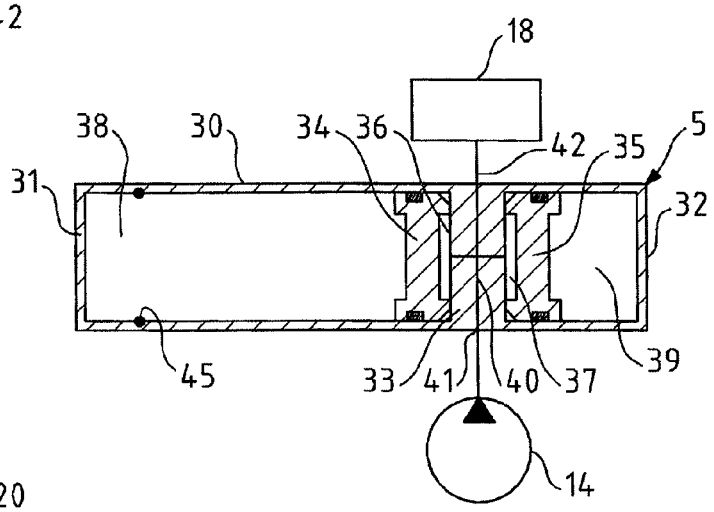
FIG. 2 is a schematic cross section of a double pressure accumulator assembly that can be used in the depth-control device of FIG. 1.

FIG. 2 depicts one particular embodiment of the pressure accumulator assembly 5 which offers advantages in terms of compactness and simplicity of implementation.

A hollow rigid cylindrical envelope 30, the two ends of which are closed by end walls 31 and 32 is divided in two by an intermediate transverse wall 33. The interior space comprised between the intermediate transverse wall 33 and the end wall 31 constitutes the low-pressure accumulator whereas the interior space comprised between the intermediate transverse wall 33 and the end wall 32 constitutes the high-pressure accumulator. In each accumulator, a piston 34 and 35 respectively, is slideably mounted in a sealed manner, so as to separate a hydraulic chamber 36 and respectively 37, situated on the side of the intermediate transverse wall 33 from a gas chamber 38 and respectively 39, situated on the side of the end wall 31 and respectively 32. FIG. 2 depicts the state of minimum filling of the hydraulic chambers 36 and 37, in which the pistons 34 and 35 are in abutment against the intermediate wall 33.

On the low-pressure accumulator side, the rigid space 30 also comprises an end-of-travel stop 45 which limits the movement of the piston 34 toward the end wall 31. The end-of-travel stop 45 delimits the maximum volume of the hydraulic chamber 36 and therefore the minimum volume of the gas chamber 38. Because a certain quantity of gas is trapped in the gas chamber 38, the minimum volume thereof also corresponds to the maximum gas pressure in the low-pressure accumulator. On the high-pressure accumulator side, there is no end-of-travel stop 45 provided. However, the movement of the piston 35 must never be so much as to come into contact with the end wall 32. That position, which has not been depicted, would actually correspond to destruction of the accumulator. In order to avoid that, the inflation pressure in the high-pressure accumulator is fixed at a level compatible with the maximum pressure that the ballast space 11 can withstand during operation of the probe, as a safety precaution. For example, the inflation pressure in the high-pressure accumulator is fixed at approximately one tenth of the maximum pressure that the ballast space 11 can withstand during operation of the probe.

Fluid canals 40 are hollowed into the thickness of the intermediate wall 33 to connect each of the hydraulic chambers 36 and 37 in parallel to a first opening 41, situated on the exterior surface of the rigid envelope 30 and to which the outlet of the pump 14 is connected, and to a second opening 42, likewise situated on the exterior surface of the rigid envelope 30 and to which the hydraulic distributor 18 is connected.

In the state of minimum filling depicted in FIG. 2, the pressure in the gas chamber 38 is, for example, of the order of 0.2 to 0.5 MPa. The pressure in the gas chamber 39 is far higher, for example of the order of 2 to 5 MPa.

Finally, returning to FIG. 1, a power supply unit 20 is also housed in the body 2 to drive the operation of the electric pump unit and the hydraulic distributor 18, as indicated schematically by the arrow 21. The power supply unit 20 consists for example of an electric battery and an electronic board.

Figure 3:
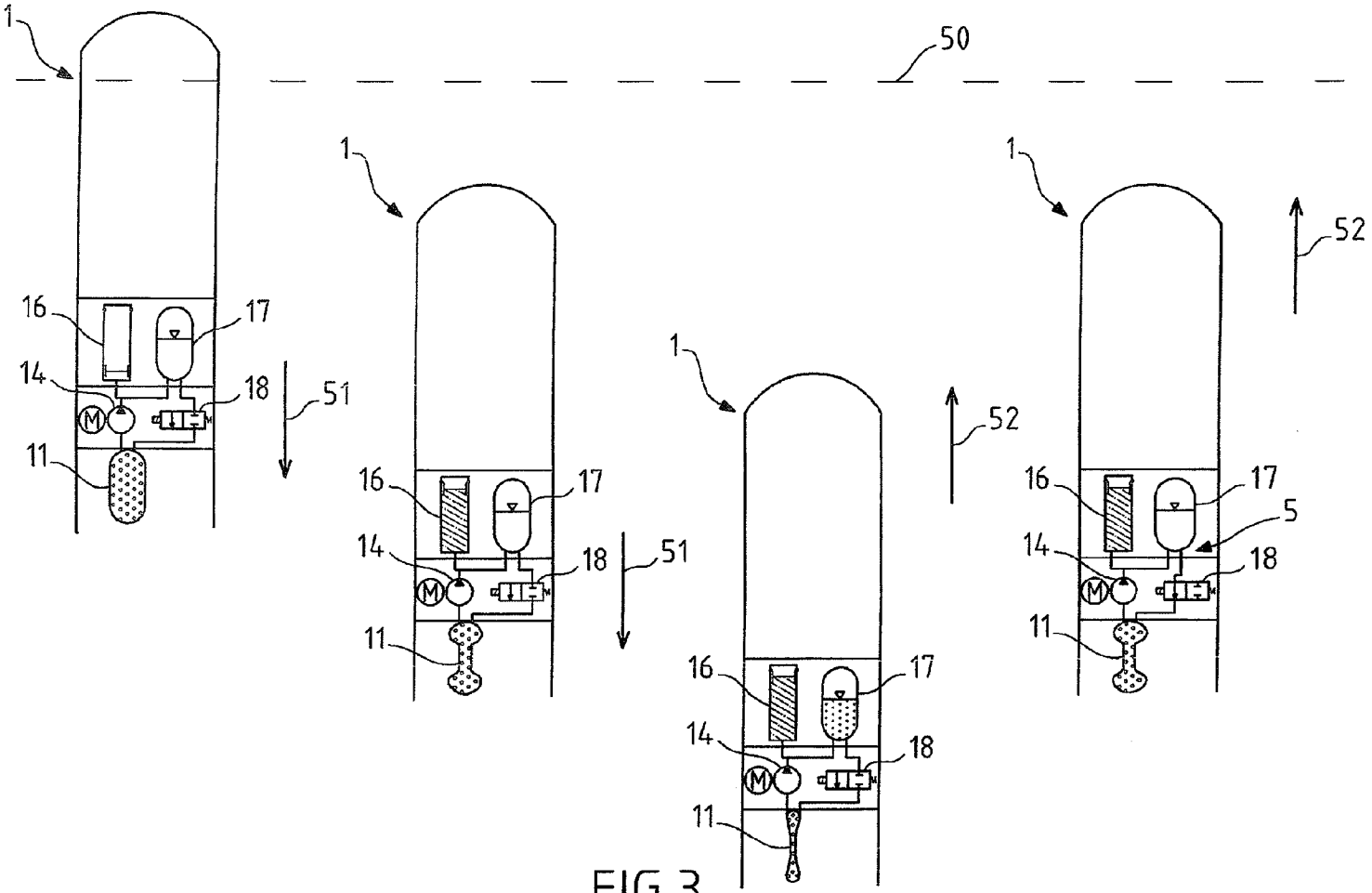
FIG. 3 is a synoptic diagram depicting the underwater probe of FIG. 1 in various phases of operation.

The operation of the depth-control device 10 in one embodiment will now be described with reference to FIG. 3. In FIG. 3, the probe 1 is capable of achieving a state of buoyancy, depicted on the left, and states of diving to various depths. FIG. 3 thus depicts the probe 1 in various successive positions corresponding to a diving movement, indicated by the arrows 51, followed by a reascent movement, indicated by the arrows 52. The line 50 represents the surface of the water.

In order to keep the probe 1 at a given level, all that is required is to prevent any movement of fluid between the ballast space 11 and the pressure accumulators 16 and 17, for example by keeping the hydraulic distributor 18 in the closed state and the pump 14 in an inactive state. For preference, the hydraulic distributor 18 and the pump 14 are designed to exhibit a leakage rate that is negligible on the scale of the duration of autonomy of the probe 1, which is for example two years or more.

In the first position starting from the left in FIG. 3, the ballast space 11 is in a state of maximum filling corresponding to the probe 1 floating on the surface. The pressure accumulators 16 and 17 are in the state of minimum filling.

In order to begin the dive of the probe 1, the pump 14 is activated by the power supply unit 20. The hydraulic distributor 18 remains in the closed state. Given the lower gas pressure, the low-pressure accumulator 16 first of all fills, as visible in the first position starting from the left in FIG. 3. The pumping of fluid is initially between the ballast space 11, which is substantially at atmospheric pressure, and the low-pressure accumulator 16, which is at a slightly higher pressure. The power consumed by the pump 14, which is dependent on the difference in pressure between the suction inlet and the delivery outlet, is therefore relatively low.

In the initial position of buoyancy of the probe 1, it may be necessary to cause a not-negligible proportion of the probe 1 to emerge, for example to facilitate radio transmissions. As a result, a relatively high volume of fluid will need to be transferred to the ballast space 11 in order to achieve this position and from the ballast space 11 in order to leave this position. As these transfers are performed at the surface, it is sufficient to provide a pressure very slightly higher than atmospheric pressure in the low-pressure accumulator 16, and a relatively high capacity.

As the volume of the ballast space 11 decreases, the filling of the low-pressure accumulator 16 increases, as does the pressure of gas therein. At the same time, the probe 1 sinks more deeply into the water and so the exterior pressure on the ballast space 11 increases. This exterior pressure is passed on to the suction inlet of the pump 14, so that the power consumed by the pump 14 remains relatively low.

The second position starting from the left in FIG. 3 corresponds to the state of maximum filling of the low-pressure accumulator 16. From this point on, the entire transfer of additional fluid is to the high-pressure accumulator 17. The depth achieved is, for example, comprised between 100 m and 200 m and the pressure in the low-pressure accumulator 16 is, for example, comprised between 1.5 and 2 MPa in that state. For preference, the inflation pressure of the high-pressure accumulator 17 is higher than this value, which means that the high-pressure accumulator 17 has not yet begun to fill. Thus, the entire capacity of the high-pressure accumulator 17 is still available for achieving greater depths, the maximum of which will be dependent on the volumetric ratio of the high-pressure accumulator 17.

The third position starting from the left in FIG. 3 corresponds to the state of minimum filling of the ballast space 11, and therefore to the position of maximum depth of the probe 1. The gas pressure in the high-pressure accumulator 17 has increased as a function of the filling thereof, as the probe 1 has sunk deeper into the water and therefore as the exterior pressure on the ballast space 11 has increased further. Thus, throughout the dive phase, the electric pump unit delivers fluid into the pressure accumulator assembly 5 which remains at a pressure slightly higher than that of the ballast space 11, which means that the electrical power consumption is relatively low. The depth achieved is for example comprised between 2000 and 4000 m, and the gas pressure in the high-pressure accumulator 17 reaches, for example, 20 to 50 MPa.

To take a more specific numerical example, let us assume that the low-pressure accumulator 16 is initially inflated to 0.2 MPa (2 bar). The transfer of the volume useful in losing buoyancy will for example raise this accumulator to 1 MPa (10 bar). The low-pressure accumulator 16 is then practically in abutment against the mechanical stop 45. If the probe 1 is designed to descend to 3000 meters (i.e. an exterior pressure of 30 MPa on the space 11), the high-pressure accumulator 17 may for example be inflated initially to 4 MPa and the pressure attained in the high-pressure accumulator 17 at the depth of 3000 meters will be of the order of 34 MPa (340 bar). The pressure ratio 34/4 is compatible with acceptable operation for a high-pressure hydropneumatic accumulator. At its deepest, the pump 14 will be supplied at 30 MPa and will need to deliver at 34 MPa, which represents an energy expenditure in proportion with the difference in pressure (34-30) MPa.

In the same way, although a very high external pressure is being applied to the ballast space 11, the hydraulic distributor 18 which needs to remain perfectly sealed throughout the dive phase withstands only the difference in pressure between the ballast space 11 and the high-pressure accumulator 17, which is limited for example to a few megapascals. This relatively low demand makes it easier to create a hydraulic distributor that is perfectly sealed. In addition, the energy required to open the hydraulic distributor 18 remains relatively low since this is proportional to this difference in pressure.

The reascent phase is depicted in the right-hand view in FIG. 3. To begin the reascent movement, all that is required is for the hydraulic distributor 18 to be switched to the open state and for the pump to be deactivated. The difference in pressure naturally causes a transfer of fluid from the pressure accumulator assembly 5 to the ballast space 11, so that the upthrust increases and the probe 1 reascends toward the surface 50. This reascent movement may be halted at an intermediate position or continued all the way to the surface, in which case the probe 1 returns to the state depicted in the view on the left.

If use is made of a hydraulic distributor 18 the default state of which is open, this reascent movement may be obtained without any consumption of energy, and therefore also in the event of a total loss of electrical power. In any event, the electrical consumption of the hydraulic distributor 18 is very low by comparison with the consumption of the pump 14.

The hydraulic pump 14 may be embodied in various ways. A swashplate oscillating pump with fixed swashplate gives satisfactory results. As with the hydraulic distributor 18, the relatively low demand regarding the pressure difference that the pump 14 has to be able to withstand makes it easier to produce a pump that is perfectly sealed and reliable over a lengthy period of time.

As an alternative, the pressure accumulator unit 5 may be embodied in various ways, for example with one single pressure accumulator or with a higher number of pressure accumulators connected in parallel. A spring-loaded accumulator may be used on the low-pressure side.

Various automatic control functions may be carried onboard the probe 1, for example using a programmed computer and position sensors, such as a pressure sensor, a GPS receiver, etc. In one embodiment, the power supply unit 20 is controlled by such a computer, not depicted.

In a simplified embodiment, for example for a system limited to shallow depths, it is possible to provide just one pressure accumulator operating at a relatively low pressure.

Although the invention has been described in conjunction with a number of particular embodiments, it is quite obvious that it is not in any way restricted thereto and that it comprises all technical equivalents of the means described and combinations thereof where these fall within the scope of the invention.

The use of the verb "to comprise", "to have" or "to include" and of the conjugated forms thereof does not exclude the presence of elements or steps other than those listed in a claim. The use of the indefinite article "a" or "an" for an element or a step does not, unless mentioned otherwise, exclude there being a plurality of such elements or steps.

In the claims, any reference symbols between parentheses must not be interpreted as a limitation on the claim.

The invention claimed is:

1. A hydraulic depth-control device for a submersible body, the device comprising:

a variable-volume ballast space;

a pressure accumulator comprising a hydraulic chamber delimited by one of a deformable wall and a mobile wall and a loading means applying a load higher than atmospheric pressure to the one of the deformable wall and the mobile wall;

a hydraulic pump coupled to an electric motor, the hydraulic pump having a suction inlet connected to the ballast space and a delivery outlet connected to the hydraulic chamber of the pressure accumulator;

a return hydraulic circuit connecting the hydraulic chamber of the pressure accumulator to the ballast space via an electrically operated valve, the return hydraulic circuit being arranged in bypass of the hydraulic pump;

a hydraulic fluid arranged in the ballast space, the hydraulic pump, the hydraulic chamber of the pressure accumulator and the return hydraulic circuit; and an electric control module able to power the electric motor of the pump and the electrically operated valve in a controlled manner, the electric control module being configured to activate the hydraulic pump and keep the electrically operated valve in a closed configuration so as to transfer hydraulic fluid from the ballast space into the hydraulic chamber of the pressure accumulator in order to cause a diving phase and, in order to cause a reascent phase, deactivate the hydraulic pump and keep the electrically-operated valve in an open configuration so as to transfer hydraulic fluid from the hydraulic chamber of the pressure accumulator to the ballast space.

2. The device as claimed in claim 1, in which the electrically-operated valve adopts the open configuration when not powered and is able to be switched into the closed configuration in response to an electrical power signal.

3. The device as claimed in claim 1, in which the electrically-operated valve adopts the closed configuration when not powered and is able to be switched into the open configuration in response to an electrical power signal.

4. The device as claimed in claim 1, in which the pressure accumulator comprises a low-pressure accumulator comprising a first hydraulic chamber delimited by one of a first deformable wall and a first mobile wall and a first loading means, and a high-pressure accumulator comprising a second hydraulic chamber delimited by one of a second deformable wall and a second mobile wall and a second loading means applying a load to the one of the second deformable wall and the second mobile wall, the delivery outlet of the pump being connected in parallel to the first hydraulic chamber and to the second hydraulic chamber, the first hydraulic chamber and the second hydraulic chamber being connected in parallel to the return hydraulic circuit, the load of the first loading means on the one of the first deformable wall and the first mobile wall being comprised between atmospheric pressure and the load of the second loading means on the one of the second deformable wall and the second mobile wall.

5. The device as claimed in claim 4, in which the low-pressure accumulator comprises a blocking means, blocking one of a movement and a deformation of the one of the deformable wall and the mobile wall when the hydraulic chamber reaches a predefined volume, so that the gas pressure in the gas chamber does not exceed a predefined maximum pressure.

6. The device as claimed in claim 4, in which the capacity of the low-pressure accumulator is greater than the capacity of the high-pressure accumulator.

7. The device as claimed in claim 4, in which the pressure accumulator is a hydropneumatic accumulator in which the loading means further comprises a gas chamber separated from the hydraulic chamber by the one of the deformable wall and the mobile wall, the gas chamber containing a gas at an absolute pressure higher than atmospheric pressure.

8. The device as claimed in claim 7, in which the pressure accumulator is an hydropneumatic accumulator, the absolute gas pressure in the first gas chamber being comprised between atmospheric pressure and the gas pressure in the second gas chamber.

9. The device as claimed in claim 8, in which the gas pressure prevailing in the second gas chamber for a state of minimum filling of the second hydraulic chamber is greater than the predefined maximum pressure of the first gas chamber.

10. The device as claimed in claim 8, in which the low-pressure accumulator comprises a first rigid cylindrical space containing the first hydraulic chamber and the first gas chamber and the mobile wall produced in the form of a first piston sliding in a sealed manner in the first rigid cylindrical space and separating the first hydraulic chamber from the first gas chamber;

in which the high-pressure accumulator comprises a second rigid cylindrical space containing the second hydraulic chamber and the second gas chamber and the mobile wall produced in the form of a second piston sliding in a sealed manner in the second rigid cylindrical space and separating the second hydraulic chamber from the second gas chamber; and in which the first and second rigid cylindrical spaces are arranged coaxially on each side of a separation wall, the first gas chamber being defined between the first piston and a first end wall closing one side of the first rigid space opposite to the separating wall, the first hydraulic chamber being defined between the first piston and the separating wall;

the second gas chamber being defined between the second piston and a second end wall closing one side of the second rigid space opposite to the separating wall, the second hydraulic chamber being defined between the second piston and the separating wall;

a fluid canal arranged in the separating wall, the fluid canal having an opening opening onto an exterior surface of the separating wall, a first branch connecting the opening to the first hydraulic chamber and a second branch connecting the opening to the second hydraulic chamber;

the opening of the fluid canal being connected to the return hydraulic circuit and to the hydraulic pump.

11. The device as claimed in claim 10, in which the first piston is in abutment against the separating wall in a state of minimum filling of the first hydraulic chamber and the second piston is in abutment against the separating wall in a state of minimum filling of the second hydraulic chamber.

12. The device as claimed in claim 1, in which the hydraulic pump is a swashplate micropump.

13. An underwater probe comprising a submersible body, the submersible body containing a sensor able to measure a physical property of the environment of the probe, a wireless communication device able to transmit measurements acquired by the sensor and a device as claimed in one of claim 1 for controlling the depth of the submersible body.

* * * * *